US006689273B1

(12) United States Patent
Kalnes et al.

(10) Patent No.: US 6,689,273 B1
(45) **Date of Patent: *Feb. 10, 2004**

(54) MULTIREACTOR PARALLEL FLOW HYDROCRACKING PROCESS

(75) Inventors: Tom N. Kalnes, LaGrange, IL (US); Stephen R. Dunne, Algonquin, IL (US); Vasant P. Thakkar, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 119 days.

This patent is subject to a terminal disclaimer.

(21) Appl. No.: 09/992,163

(22) Filed: Nov. 6, 2001

Related U.S. Application Data

(63) Continuation-in-part of application No. 09/407,107, filed on Sep. 27, 1999, now Pat. No. 6,312,586.

(51) Int. Cl.[7] ..... C10G 69/14

(52) U.S. Cl. ..... 208/80; 208/58; 208/59; 208/78; 208/168

(58) Field of Search ..... 208/80, 78, 58, 208/59, 108

(56) References Cited

U.S. PATENT DOCUMENTS

| | | | | | |
|---|---|---|---|---|---|
| 1,347,544 | A | * | 7/1920 | Jones | 208/78 |
| 1,942,120 | A | * | 1/1934 | Plummer | 422/190 |
| 2,340,814 | A | * | 2/1944 | Lidov | 208/80 |
| 2,373,888 | A | * | 4/1945 | Hachmuth | 422/109 |
| 2,387,477 | A | * | 10/1945 | Thomas | 208/78 |
| 2,440,822 | A | * | 5/1948 | Hachmuth | 585/300 |
| 2,671,754 | A | | 3/1954 | DeRosset et al. | 196/28 |
| 3,788,976 | A | | 1/1974 | Kirk | 208/89 |
| 3,859,203 | A | | 1/1975 | Brunn et al. | 208/216 |
| 3,887,455 | A | * | 6/1975 | Hammer et al. | 208/112 |
| 4,194,964 | A | | 3/1980 | Chen et al. | 208/108 |
| 5,817,589 | A | | 10/1998 | de Agudelo et al. | 502/53 |
| 5,904,835 | A | | 5/1999 | Thakkar | 208/78 |
| 6,106,695 | A | * | 8/2000 | Kalnes et al. | 208/59 |
| 6,312,586 | B1 | * | 11/2001 | Kalanes et al. | 208/80 |

OTHER PUBLICATIONS

Scherzer, Julius et al. "*Hydrocracking Science and Technology*", Marcel Dekker, Inc. (1996) pp. 174–208 . . . ISBN 0–8247–9760–4 TP690.4.S34.

Chen, N.Y. et al. "*New Process Cuts Pour Point of Distillates*" Oil & Gas Journal (Jun. 6, 1977) pp. 165–170.

* cited by examiner

*Primary Examiner*—Walter D. Griffin
*Assistant Examiner*—Tam Nguyen
(74) *Attorney, Agent, or Firm*—John G. Tolomei; James C. Paschall; John G. Cutts

(57) ABSTRACT

Heavy hydrocarbons are upgraded to higher value distillates in a hydrocarbon conversion process which employs several parallel on-stream reaction zones which each contain both hydrotreating and hydrocracking catalyst beds. The feed and liquid recycled from the bottom of the reaction zone is charged to the top of the uppermost catalyst bed. Hydrogen flow in the reaction zones is countercurrent to the descending liquid, and products are removed as vapor. The flow of feed to one of the reaction zones is periodically stopped to allow sequential on-stream hydrogenative regeneration of the catalysts within the reaction zones. This allows continuous commercial operation at conditions which are otherwise unfeasible.

12 Claims, 1 Drawing Sheet

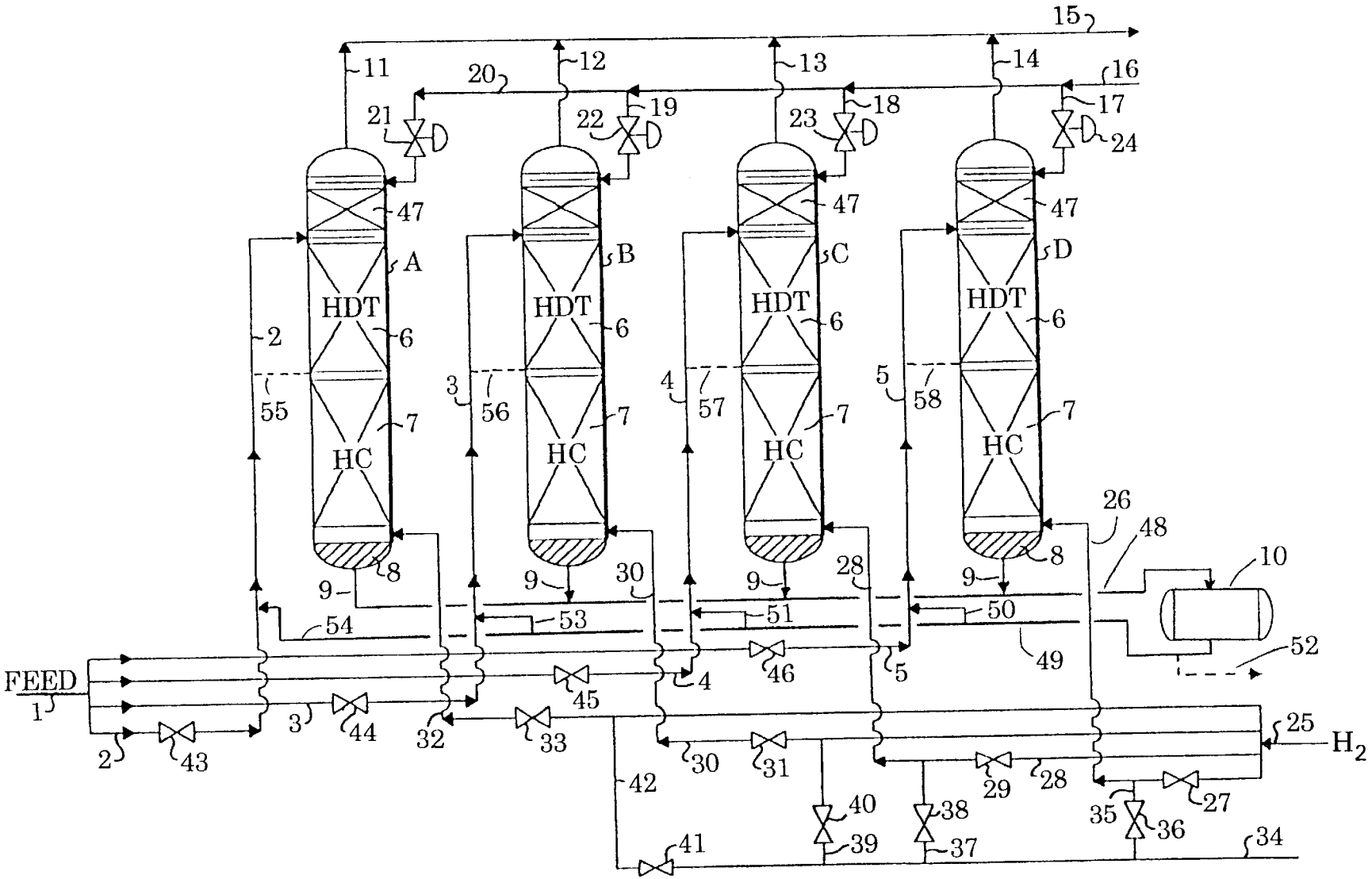
HDT
HC
A
B
C
D
FEED
$H_2$

MULTIREACTOR PARALLEL FLOW HYDROCRACKING PROCESS

CROSS REFERENCE TO RELATED APPLICATION

This application is a continuation-in-part of our prior application Ser. No. 09/407,107 filed Sep. 27, 1999 and now issued as U.S. Pat. No. 6,312,586. The entire teaching of our prior application is incorporated herein.

FIELD OF THE INVENTION

The invention relates to a hydrocarbon conversion process. More specifically the invention relates to a flow scheme for a hydrocracking process as used in petroleum refineries to convert heavy feed stocks into lighter, higher value distillate streams such as naphtha and jet fuel.

BACKGROUND OF THE INVENTION

Large quantities of petroleum derived feeds are converted into higher value hydrocarbon fractions by a process referred to as hydrocracking. In this process the heavy feed is contacted with a fixed bed of a solid catalyst in the presence of hydrogen at conditions of high temperature and pressure. This results in a substantial portion of the feed stream molecules being broken down into molecules of smaller size and greater volatility.

Large quantities of petroleum derived hydrocarbons are converted into higher value hydrocarbon fractions used as motor fuels through use of a hydrocracking process unit. In the hydrocracking process the heavy feed is contacted with a fixed bed of a solid catalyst in the presence of hydrogen at conditions of high temperature and pressure which results in a substantial portion of the molecules of the feed stream being broken down into molecules of smaller size and greater volatility. The high economic value of hydrocarbon fuels has led to extensive development of both hydrocracking catalysts and the process technology.

Many molecules in the raw petroleum fraction fed to the hydrocracking process contain significant amounts of organic sulfur and nitrogen. The sulfur and nitrogen must be removed to meet modern fuel specifications. Removal or reduction of the sulfur and nitrogen is also beneficial to the operation of a hydrocracking reactor. The sulfur and nitrogen is removed by a process referred to as hydrotreating. Due to the similarity of the process conditions employed in hydrotreating and hydrocracking the two processes are often integrated into a single overall process unit having separate sequential reactors dedicated to the two reactions and a common product recovery section.

RELATED ART

Hydrocracking processes are used commercially in a large number of petroleum refineries. They are used to process a variety of feeds ranging from naphtha to very heavy crude oil residual fractions. In general, the hydrocracking process splits the molecules of the feed into smaller molecules having higher average volatility and economic value. At the same time a hydrocracking process normally improves the quality of the material being processed by increasing the hydrogen to carbon ratio of the materials, and by removing sulfur and nitrogen. The significant economic utility of the hydrocracking process has resulted in a large developmental effort being devoted to the improvement of the process and to the development of better catalysts for use in the process. A general review and classification of the different hydrocracking process flow schemes is provided in the book entitled, "*Hydrocracking Science and Technology*" authored by Julius Scherzer and A. J. Gruia, published in 1996 by Marcel Dekker, Inc. Specific reference is made to the chapter beginning at page 174 which describes single stage, once-through and two-stage hydrocracking process flow schemes and product recovery flows.

U.S. Pat. No. 5,904,835 issued to V. P. Thakkar describes a hydrocracking process in which the feed stream is divided into two portions which are fed into separate hydrocracking reaction zones.

FIG. 2 of U.S. Pat. No. 2,671,754 issued to A. J. DeRosset et al shows a hydrocarbon conversion process having counter-current flow of rising hydrogen and descending hydrocarbons through sequential desulfurization and hydrogenation zones. A similar countercurrent desulfurization and hydrogenation flow is shown in U.S. Pat. No. 3,788,976 issued to M. C. Kirk.

U.S. Pat. No. 4,194,964 issued to N. Y. Chen et al describes a hydrotreater/hydrocracker that can be operated to function as a distillation column. Hydrogen is charged to the bottom of the column and rises countercurrent to liquid phase hydrocarbons fed to the middle of the column.

It has been recognized in the art that the concentration of ammonia in the reaction zone plays an important role in moderating the activity and selectivity of hydrocracking catalysts. This is discussed at page 207 of the Scherzer text. Thus the prior art includes the addition of ammonia to downstream portions of a reaction zone as shown in U.S. Pat. No. 3,859,203 issued to L. W. Brunn et al.

Another processing technique known in the art is the rejuvenation of hydroprocessing catalyst activity by contact with hot flowing hydrogen which strips carbonaceous deposits from the catalyst. This is described in the article appearing at page 165 of the Jun. 6, 1977 edition of the Oil & Gas Journal. A variation of this involving flushing the catalyst with an inert gas is described U.S. Pat. No. 5,817,589 issued to M. Ramirez de Agudelo et al.

BRIEF SUMMARY OF THE INVENTION

The invention is a continuous hydrocracking process characterized by the retention of both hydrotreating and hydrocracking catalysts in each of several parallel countercurrent vapor-liquid flow reaction zones, by several processing steps including internal recycling of unconverted liquid to the inlet of each reaction zone and the combination of vapor removed overhead from each reaction zone to recover product hydrocarbons. Preferably, continuous and substantially uniform long term operation is provided by regenerating the catalysts in one or more reaction zones while the other reaction zones are on stream, with the effluents of all of the reactors being combined to form the stream sent to the product recovery section. The ability to perform frequent regenerations provides a new flexibility in operating conditions. Conditions which would otherwise result in commercially unacceptable short catalyst life (time between required regenerations) can be employed to increase selectivity or reduce operating costs.

One broad embodiment of the invention may be characterized as a hydrocarbon conversion process which comprises dividing a feed stream into a number of portions having the same composition and passing each portion into an upper portion of a separate reaction zone of a multi-reactor reaction section of the process, with the reaction section comprising at least two reaction zones of substantially equal configuration and operated at substantially the same conversion conditions, and with each reaction zone containing an upper first catalyst bed comprising hydrotreating catalyst and a lower second catalyst bed comprising hydrocracking catalyst; passing a hydrogen-rich gas stream into a lower portion of each reaction zone and upward through the reaction zone; collecting liquid phase hydrocarbons at the bottom of each reaction zone and recycling at least a portion of the hydrocarbons to the first catalyst bed of the same reaction zone; and combining vapor rising out of each operating reaction zone and passing the resultant combined gas stream to a product recovery zone.

The process of the invention may also be characterized as a hydrocarbon conversion process which comprises dividing a feed stream into a number of portions having the same composition and passing each portion into an upper portion of a separate on-stream reaction zone of a multi-reaction zone reaction section of the process, with the reaction section comprising at least two reaction zones of substantially equal configuration and operated at substantially the same conversion conditions, and with each reaction zone containing a catalyst bed comprising hydrocracking catalyst; passing a hydrogen-rich gas stream into a lower portion of each reaction zone and upward through the reaction zone; passing liquid phase hydrocarbons collected at the bottom of each on-stream reaction zone into a single liquid retention zone, and recycling a portion of these hydrocarbons to a catalyst bed of each on-stream reaction zone; and, combining vapor rising out of each onstream reaction zone and passing the resultant combined gas stream to a product recovery section of the process, and recovering at least one distillate product from the process.

BRIEF DESCRIPTION OF THE DRAWING

The drawing is a simplified process flow scheme showing the reaction section of the process, which contains three on-stream reaction zones A–C and a fourth zone D which is being regenerated. The feed stream 1 is split between the on-stream reaction zones, with conversion products being carried out as an overhead vapor with hydrogen from line 25.

DETAILED DESCRIPTION AND PREFERRED EMBODIMENTS

In a representative example of a conventional high conversion hydrocracking process, a heavy gas oil is charged to the process and admixed with any hydrocarbon recycle stream. The resultant admixture of these two liquid phase streams is heated in an indirect heat exchange means and then combined with a hydrogen-rich recycle gas stream. The admixture of charge hydrocarbons, recycle hydrocarbons and fresh hydrogen is heated if necessary and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, and other reaction by-products such as hydrogen sulfide and ammonia formed by hydrodesulfurization and hydro-denitrification reactions which occur within the hydrocracking reaction zone. The reaction zone effluent will also contain the desired product hydrocarbons boiling in the gasoline, diesel fuel, kerosene or fuel oil boiling point ranges and some "unconverted" feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from the reactor bed, heat exchanged with the feed to the reaction zone and then passed into a vapor-liquid separation zone normally referred to as a high pressure separator. Additional cooling can be done prior to this separation. In some instances a hot flash separator is used upstream of the high pressure separator. The use of cold separators to remove condensate from vapor removed from a hot separator is another option. The liquids recovered in these vapor-liquid separation zones are passed into a product recovery section containing one or more fractionation columns. Product recovery methods for hydrocracking are well known and conventional methods may be employed in the subject invention. In many instances the conversion achieved in the hydrocracking reactor(s) is not complete and some heavy hydrocarbons are removed from the product recovery zone as a "drag stream," which is removed from the process, and/or as a recycle stream. The recycle stream is preferably passed into the hydrotreating (first) reactor in a hydrotreating-hydrocracking sequence as this reduces the capital cost of the overall unit. It may, however, sometimes be passed directly into a hydrocracking reactor.

While conventional hydrocracking processes provide high rates of feed conversion to valuable products and long cycle times between regeneration or replacement of the catalysts, the processes continue to provide less than desired selectivity to desired products. Much of the feed stream is converted to less desired, lower value by-products. Other major units in refineries used for catalytic cracking and reforming have evolved in a manner which allows for continuous uniform long term operation. However, the hydrocracking process is often limited to fixed bed operation, and the fixed bed catalysts slowly deactivate leading to the need to increase temperature and eventually shut down the unit for catalyst regeneration or replacement. Therefore, many areas for improvement in hydrocracking still remain. It is an objective of the subject invention to provide a hydrocracking process providing continuous and uniform operation which remains relatively constant in terms of feed conversion, reaction temperature and product selectivity. It is another objective of the process to provide a more selective hydrocracking process.

The process feed stream should have a 5% boiling point above 350° F. (177° C.) and preferably above 400° F. (204° C.). Therefore substantially all (at least 90 vol. %) of the process feed stream will fall within the boiling point range between about 300° F. and 1050° F. and preferably between 600° F. and 1000° F. A feed can be made up of a mixture of petroleum fractions such as atmospheric and vacuum gas oils (AGO and VGO). Suitable feedstocks for the subject process include virtually any heavy hydrocarbonaceous mineral or synthetic oil or a mixture of one or more fractions thereof. Thus, such known feedstocks as straight run gas oils, vacuum gas oils, demetallized oils, deasphalted vacuum residue, coker distillates, cat cracker distillates, shale oil, tar sand oil, coal liquids and the like are contemplated. The preferred feedstock will have a boiling point range starting at a temperature above about 260° Celsius (500° F.) and does not contain an appreciable concentration of asphaltenes. The hydrocracking feedstock may contain nitrogen, usually present as organonitrogen compounds in amounts between 1 ppm and 1.0 wt. %. The feed will normally also contain sulfur-containing compounds sufficient to provide a sulfur content greater than 0.15 wt. %.

On-stream reaction zone conversion conditions employed in the subject process are within the broad ranges known in the art for hydrocracking. The conditions chosen should provide at least 20 vol. % per pass conversion of the feed stream and preferably over 40 vol % conversion. Targeted conversions per pass, and operating conditions, will be dependent on many factors including the feed composition, desired products, desired operating variables, such as combined feed ratio (CFR) and catalyst characteristics. Hydrocracking and hydrotreating reaction temperatures are in the broad range of 400° to 1200° F. (204–649° C.), preferably between 600° and 900° F. (316–482° C.). Reaction pressures are preferably between about 800 and about 3000 psi (5,516–20,685 kPa). A temperature above about 316° C. and a total pressure above about 8270 kPa (1200 psi) are highly preferred. The direct connection between the hydrotreating and hydrocracking catalyst beds means that the pressure and temperature in the two catalyst beds will be linked and differ basically only by changes inherent in the operation of the process, e.g. pressure drop through the reaction zone, heat released by the exothermic reactions and the possible addition of interbed quench. Contact times in a hydrocracking process usually correspond to liquid hourly space velocities (LHSV) in the range of about 0.1 $hr^{-1}$ to 15 $hr^{-1}$, preferably between about 0.5 and 3 $hr^{-1}$. In the subject process it is greatly preferred to operate with a significant recycle rate and conventional feed space velocity resulting in a combined feed rate or CFR in the range of 2–4, with a CFR greater than 1.5 being preferred. Hydrogen circulation rates are in the range of 1,000 to 50,000 standard cubic feet (scf) per barrel of charge (178–8,888 std. $m^3/m^3$), preferably between 2,000 and 20,000 scf per barrel of charge (355–3, 555 std. $m^3/m^3$).

The operation of the subject process can be readily discerned by reference to the drawing. The drawing illustrates one preferred embodiment of the invention in which four reaction zones of identical configuration are employed. This description of the drawing is only intended to describe this embodiment and some variations. It is not intended to limit the scope of the invention to the depicted flows. Other embodiments may employ a different number of reaction zones ranging from 2 to 8 or more. The number of reaction zones employed in the process will not fundamentally change the procedures or methods of operation described herein. The number of reaction zones will be dependent on such factors as desired total feed capacity of the unit and local economics. Referring now to the drawing, a feedstream comprising heavy hydrocarbonaceous compounds such as found in a vacuum gas oil or gas oil or mixture of these materials enters the process through line 1. The flow of the feedstream is then divided into three substantially equal portions having the same composition and separately passed into three of the reactions zones. At the moment in time represented by this depiction of the process it is assumed that reaction zones A, B and C are on-stream and reaction zone D is undergoing a regeneration step. There is, therefore, no passage of the feedstream material into reaction zone D through line 5. Instead, the entire flow of the feedstream of line 1 is divided between lines 2, 3 and 4. The following description will only focus on reaction zone A as the operation in each of the three on-stream zones is identical.

The portion of the feedstream passing through line 2 is admixed with a stream of recycle liquid from line 54. This recycle liquid is derived from liquid hydrocarbons 8 collected at the bottom of the reaction zone A and removed through line 9. This liquid may form a pool at the bottom of the reaction zone although this is not preferred as the liquid is allowed to drain from the reaction zone. The liquid collected at the bottom of each reaction zone is collected by a header system of lines 9 and 48 and delivered to the liquid retention zone 10. The stream of recycle material is slightly pressurized in a pump not shown and admixed with the portion of the feedstream travelling through line 2. The admixture of recycle and fresh feed is then passed into an upper portion of the reaction zone A through a feed distributor. The material flowing through line 2 must be brought up to a temperature suitable for passage into the reaction zone. This temperature may cause some flashing of the entering feed material as it enters the reaction zone, especially due to the presence of hydrogen and vapor-phase hydrocarbons in the reaction zone. Heat exchanger(s) and a fired heater required to raise the temperature of the feed stream to the desired inlet conditions of the reaction zone are customary in the art are not illustrated on the drawing. As there are many alternative methods of practicing feed heating and they are conventional in nature, this equipment has not been illustrated on the drawing. Due to the exothermic nature of the reactions being performed, the recycling of a large amount of hot liquid from the reaction zone effluent will supply much of the required feed preheat requirement. Heaters will be required for startup.

The great majority of the recycle and fresh feed material will pass downward as a liquid through the reaction zone and through a bed 6 of hydrotreating catalyst. This upper bed 6 is one of two catalyst beds present in each of the reaction zones A–D. In each instance the upper reaction zone comprises hydrotreating catalyst and the lower reaction zone comprises hydrocracking catalyst. The catalyst(s) in each hydrotreating bed is the same and the catalyst(s) in the hydrocracking bed is the same in each reaction zone. That is, the same catalysts are used in each reaction zone. Both the hydrotreating bed and the hydrocracking bed may, however, contain two or more different catalysts. As shown it is preferred that both catalysts and the contacting media 47 are located within a single vessel.

The feed/recycle stream of line 2 may be augmented by a small amount of liquid descending from an optional vapor-liquid contacting zone 47. The liquid descending from the contacting zone 47 will be an admixture of compounds entering the reaction section of the process through the reflux header line 16 plus those compounds which entered zone 47 as rising vapor and have been condensed due to contact with the relatively cool reflux liquid of line 16. The liquid phase material passed into the reaction section of the process by line 16 is relatively heavy material such as would be removed from the downstream high pressure separator or cold separator of the product recovery section of the process. It could also be derived in part from the unconverted liquid collected from the bottom of the reaction zones and removed from zone 10. The reflux liquid can also be derived from a source outside of the process if desired. The liquid of line 16 is not heated to reaction conditions and, therefore, is analogous to the reflux liquid which enters the top of a fractionation column. Equal portions of the liquid of header line 16 are passed into the three operating reaction zones A, B and C through lines 21, 19 and 18 at equal rates controlled by valves 21, 22 and 23. At the point of time depicted in this illustration, valve 24 would be in a closed position and there would be no flow of the cold liquid through line 17 into regenerating reaction zone D.

As the liquid phase material passes downward through the bed 6 of hydrotreating catalyst several reactions will occur. These reactions include hydrogenation of olefinic materials and saturation of aromatic compounds, but the most desired reactions are the removal of sulfur and nitrogen from the hetero compounds present in the feed and recycle components. The object of this is two fold; to produce a better quality product from the overall process, that is, a product having a reduced sulfur and nitrogen levels and, therefore, acceptable for use as motor fuel and to prepare the liquid phase material for passage into the hydrocracking catalyst bed 7. Thus it is desired that the hydrotreating catalyst convert most of the organic nitrogen and sulfur into ammonia and hydrogen sulfide which are transferred to the rising vapor. A reduction in the sulfur and nitrogen content of the materials entering the hydrocracking catalyst results in the hydrocracking catalyst and especially the hydrogenation components thereof having a higher overall activity. This allows operation of the hydrocracking bed at lower reaction temperatures which normally will result in an increased hydrogenation activity. This hydrotreating also improves the quality of any unconverted material removed from process. After passing through the hydrotreating catalyst, the remaining feed components pass into the hydrocracking catalyst. Contacting of these feed components and the hydrogen with the catalyst at the imposed conditions results in hydrocracking of the feed components into lower molecular weight hydrocarbons. These are more volatile and will tend to enter the rising vapor phase.

While the Drawing illustrates the use of both hydrotreating and hydrocracking catalysts, the subject process can be employed when the reaction zone contains only hydrocracking catalyst. Hydrotreating catalyst is normally not used upstream of amorphous hydrocracking catalyst, and the reaction zones may as an alternative to the preferred operational mode contain only amorphous hydrocracking catalyst or sulfur tolerant hydrocracking catalyst. The feed will then directly contact the hydrocracking catalyst.

As a second variation, portions of the feed, or feed and recycle material, may be passed into the hydrocracking beds directly as through optional lines 55, 56, 57, and 58. In either instance much of the hydrocracked material will be carried upward into the hydrotreating catalyst with the rising vapor and subjected to hydrotreating. A third variation is the passage of some or all of the recycle material from zone 10 directly into the lower hydrocracking catalyst bed. In this way it would not require admixing with the feed and would not be recirculated through the hydrotreating catalyst.

In the subject process, the hydrogen required in both the hydrocracking and hydrotreating zones is supplied near the bottom of the reaction zone and moves upward through the catalyst beds countercurrent to the descending liquid. For reaction zone A this would be via line 32 at a rate controlled by valve 33. While no means for adjusting the temperature of the hydrogen stream is shown in the drawing, means would normally be provided to adjust the temperature of the hydrogen rich gas stream flowing through the header line 25 or through each of the distribution lines 26, 28, 30 and 32. This gas stream is preferably heated to a sufficiently high temperature before passage into the reaction zones that it has a temperature greater than the feed inlet temperature. Thus the hydrogen-rich gas may have a temperature ranging from about 650° F. up to about 900° F., with temperatures no higher than 850° F. presently being preferred. The temperature of the gas steam may therefore be higher than the temperature of the on-stream reactor, such that termination of the flow of the feed allows the hydrogen-rich gas stream to begin to heat the reaction zone to desired catalyst regeneration conditions. This hydrogenative regeneration is therefore performed at conditions which include a temperature above the normal operating temperature of the reaction zone but at essentially the same pressure.

In addition to the function of supplying the hydrogen required for the hydrocracking and hydrotreating reactions which occur within the reaction zone, the upward flowing hydrogen rich gas is also intended to promote the stripping of both hydrogen sulfide and ammonia from the descending liquid such that the reactants passing downward through the hydrocracking zone are relatively sweet and may be processed in an environment which is relatively free of organic sulfur and nitrogen. In addition, it is intended that the upward flow of vapor will remove the more volatile products of the hydrocracking reactions from the reaction zone by causing them to travel upward through the catalyst beds 6 and 7 and also through the contacting zone 47 to emerge overhead from the reaction zone. In the case of reaction zone A there is, therefore, formed an overhead vapor stream carried by line 11 which comprises residual hydrogen, ammonia, hydrogen sulfide, light hydrocarbons formed as reaction byproducts, intended distillate hydrocarbon products such as hydrocarbons boiling in the naphtha, kerosene and diesel boiling ranges plus some small amount of unconverted hydrocarbons. Similar streams are being removed at the same time from on-steam reaction zones B and C via overhead lines 12 and 13, respectively. While reaction zone D is not processing feed materials at this point in time, a hydrogen-rich overhead stream is removed through line 14. This overhead stream comprises hydrogen rich gas and various hydrocarbons. The admixture of these four gas streams is then combined and passed through line 15 to a product recovery section which may be of conventional design. The product recovery steps would normally comprise one or more stages of partial condensation and separation into vapor and liquid fractions followed by stripping and fractional distillation of the combined liquid fractions. Unconverted feed components which are concentrated in the product recovery zone may be recycled as by admixture into the feed or by passage directly into the catalyst beds containing hydrocracking catalyst.

As an alternative the vapor of line 15 may be passed into a hydrotreating zone intended to upgrade the quality of diesel or jet fuel boiling range products recovered from the overall process. This hydrotreating would be intended to compensate for the reduced hydrotreating which results in from operating the reaction zones at relatively low pressures on the order of 1,000 psig. The vapor of line 15 may be cooled prior to being hydrotreated.

While on-stream reaction zones A, B and C are processing the feed material of line 1, reaction zone D is undergoing regeneration. This regeneration is performed without decoupling the reaction zone from the overall process. This greatly simplifies the mechanical design of the process as the reaction zone being regenerated stays at the pressure of the on-stream zones. The flows of fresh feed through line 5 and of reflux liquid into the reaction zone via line 17 are terminated. Preferably all of the liquid in the reaction zone when it is removed from operation is allowed to drain into a pool 8 of hydrocarbons located in a boot at the bottom of the reaction zone. The regeneration technique preferred for the subject process is the passage of heated hydrogen upward through the reaction zone at a pressure substantially equal to that employed while the reaction zone is on stream and with the temperature of the rising hydrogen being gradually increased during the regeneration step. The upward flowing hydrogen first strips off liquid phase hydrocarbons and then promotes the removal of semi-solid or solid carbonaceous deposits from the catalyst. The presence of a significant level of hydrogen also promotes the inherent hydrogenation and cracking functions of the catalyst which tend to help in the breakdown of the carbonaceous material collected on the catalyst including basic nitrogen-containing moieties.

The length of the regeneration step may be controlled based upon monitoring the composition of the gas stream removed through line 14 or may be performed for a predetermined time period. The length of time required to regenerate the catalyst(s) of a reaction zone may be less than the onstream time of the on-stream reaction zones. In this case the reaction zone which was being regenerated may be returned to on-stream operation prior to the need to regenerate another reaction zone. The result of this would be that all reaction zones would be in operation at the same time. This is more desirable when the process contains a small number e.g. two or three reaction zones.

This hydrogen stripping form of regeneration may not completely restore the activity of the catalysts resulting in a need to periodically shut down the process for a more conventional oxygenative regeneration of the catalyst. Hydrogen stripping of a particular reaction zone will preferably not occur more often than once a week.

Header line 34 provides a hydrogen-rich gas stream which may contain a significant amount of ammonia and/or hydrogen sulfide. The purpose of this gas stream is to allow an independent control of the ammonia and hydrogen sulfide concentrations in the on-stream reaction zones A, B and C and in the regenerating reaction zone D. The desirability of adding hydrogen sulfide and ammonia to the reaction zones is dependent upon the composition of the catalysts employed in the reaction zones. This is primarily determined by whether the catalysts contain a base metal such as nickel or molybdenum or a noble metal such as platinum and palladium. The addition of sulfur and ammonia is required when a base metal hydrocracking catalyst is employed in bed 7. Controlled amounts of the ammonia and hydrogen sulfide containing gas are therefore passed into reaction zones A, B and C through lines 37, 39 and 42 at rates controlled by valves 38, 40 and 41.

While reaction zone D is not being employed at this time for the conversion of entering feed compounds and it is therefore unnecessary to moderate the activity of the catalyst, it is normally preferred to feed a controlled amount of hydrogen sulfide into the hydrogen rich gas entering the reaction zone undergoing regeneration. The purpose of this is to maintain the metal components of the catalyst in the same state as during their use for conversion, that is as sulfides. The amount added to reaction zone D via lines 35 and 26 is controlled by valve 36 and may differ from the amounts being charged to the operating reaction zones A, B and C. The amount of this gas passed into reaction zone D may also vary during the regeneration procedure, which ends in cooling the catalyst to on-stream conditions.

When it is desired to regenerate the catalyst present in one of the reaction zones, the flows of hydrocarbon streams into that reaction zone are terminated. That is, both the flow of the feedstream material and the liquid cooling or reflux material derived from line 16 are terminated to that specific reaction zone. The catalyst beds and distributors of the reaction zones have a significant inventory of liquid, and this liquid will drain downward through the reaction zone and accumulate at the bottom of the reaction zone. A substantial quantity or pool 8 of this liquid may be retained in a large empty volume or boot present at the bottom of the reaction zone. One of the primary drivers for this is the desire to reuse this liquid during the return of the reaction zone to on-stream operation. For instance, as one of the initial steps in restoring a reaction zone to operation collected liquid would be pumped to the top of the upper catalyst bed prior to cutting in the raw feed from line 5. The next step in the sequence would be restoring the flow of the reflux liquid of line 17. The flow of the gas stream of line 35 would also be adjusted as desired at this time to increase or decrease the amount of hydrogen sulfide and ammonia being passed into the hydrogen rich gas already flowing into the reaction zone via line 26. The flow of the feed into the reaction zone is then started.

Alternatively the on-stream liquid inventory of the reaction zone may be drained from the reaction zone as an initial step in the regeneration procedure. The liquid which accumulates in the bottom of the reaction zone may, therefore, be passed into either the product recovery section of the process or into the feed storage facility by a line not shown. This method has the advantage of reducing the required volume within the reaction zone. However, it is preferred that all liquid collected at the bottom of the reaction zones is passed into a dedicated liquid retention zone 10. This tank or other container may be vented to allow for vapor separation and discharge to downstream separation/product recovery equipment. The admixed liquid is withdrawn and passed through line 49 for recycling to on-stream reaction zones as appropriate through lines 50, 51, 53 and 54. This would require valving to prevent the passage of the recycled liquid into reaction zones undergoing regeneration. It is noted that the use of a common liquid collection zone 10 allows the operation of the process with only a single pump for this purpose rather than the multiple pumps described in our prior application.

The liquid retention zone 10 can also be used as the source for a very small, e.g. 1–5 vol. % or feed, optional drag stream which can be removed through optional line 52. While not preferred, the removal of a net drag stream allows the use of less severe conditions in the reaction zones or the processing of feeds which are harder to convert. The size of the drag stream can be in the broad range of 1–20 volume percent of the process feed stream, but is preferably less than 10 volume percent. This drag can be combined with the overhead product or routed to an FCC or other process as feed via a separate low pressure flash drum.

The term "conversion" as used herein refers to the chemical change necessary to allow the product hydrocarbons to be removed in a distillate product stream withdrawn from the product recovery zone. Hydrocarbons removed from the process as a drag stream may be a value product but are not considered to be either distillates or conversion products for purposes of this definition of conversion. The unconverted material has been hydrotreated and is suitable feed for a number of other conversion units, such as FCC or lube oil units. This definition provides for the inherent variation in feeds and desired products which exists between different refineries. Typically, this definition will require the production of distillate hydrocarbons having a boiling points below about 700° F. (371° C.). The terms "light" and "heavy" are used herein in their normal sense within the refining industry to refer respectively to relatively low and high boiling point ranges. Distillates produced by the process are normally recovered as sidecuts of a product fractionation column and include naphtha, kerosene and diesel fractions.

The subject process is especially useful in the production of middle distillate fractions boiling in the range of about 260–700° F. (127–371° C.) as determined by the appropriate ASTM test procedure. These are recovered by fractionating the liquids recovered from the effluents of the reaction zones. The term "middle distillate" is intended to include the diesel, jet fuel and kerosene boiling range fractions. The terms "kerosene" and "jet fuel boiling point range" are intended to refer to a temperature range of 260–550° F. (127–288° C.) and "diesel" boiling range is intended to refer to hydrocarbon boiling points between about 260-about 700° F. (127–371° C.). The gasoline or naphtha fraction is normally considered to be the $C_5$ to 400° F. (204° C.) endpoint fraction of available hydrocarbons. The boiling point ranges of the various product fractions recovered in any particular refinery will vary depending on such factors as the characteristics of the crude oil source, the refinery's local markets, product prices, etc. Reference is made to ASTM standards D-975 and D-3699 for further details on kerosene and diesel fuel properties and to D-1655 for aviation turbine feed.

Appropriate commercially available conventional catalyst may be employed in both the hydrotreating bed and the hydrocracking bed of each reaction zone. It is preferred that the catalyst has a physical shape which minimizes the pressure drop through the reaction zone. For instance, a cylindrical or tubular catalyst of substantial diameter or, more preferably, a polylobal catalyst of substantial diameter may be employed. Such catalysts are described in U.S. Pat. Nos. 4,080,282; 4,391,740 and 4,664,776 and in an article at page 164 of the Dec. 31, 1984 article of The Oil & Gas Journal. A highly preferred catalyst shape is a 1 to 1-½ inch penta ring. The open space provided by these structures reduces the pressure drop, and they provide geometric surface area for stripping and rectification.

In a limited embodiment one or both of the hydrotreating and hydrocracking catalysts is partially or totally in the form of monolith type catalyst. The use of monolith catalysts in hydrocarbon conversion processes is fairly novel. They are described, however, in some detail in European patent specification 0 667 807. In cross-section the a monolith style hydroprocessing catalyst resembles the catalysts commonly used in catalytic converters in automotive vehicles and in reactors used for processing gas streams. Such monolithic reactors are used for treating flue gas, engine exhaust gas and various gas streams for removing volatile organic compounds or undesirable nitrogen oxides.

If a monolith catalyst bed is used in the subject process it is preferably formed from modules containing an extruded monolithic element of at least one meter in length, with each module having a large number of small diameter (1/16–3/16 inch diameter) parallel gas passageways extending along the length of the module. Several modules may be stacked upon one another with suitable inlet and outlet connections to establish rather lengthy gas passageways. A monolith design normally provides a low pressure drop. The monoliths may be formed from alumina or a similar base material which has been wash coated with alumina or another active inorganic oxide support and then impregnated with the desired hydrogenation components. In the case of the hydrocracking catalyst bed 7 the wash coat or overcoat must also contain an active cracking component such as a Y, Beta or ZSM type zeolite.

It is preferred that at least two thirds of the internal volume of each reaction zone is devoted to the retention of catalyst. It is also preferred that both the hydrotreating catalyst bed 6 and the hydrocracking catalyst bed 7 are equal to at least ¼ of the internal volume of the reaction zone. It is highly preferred that the hydrocracking reaction zone occupies at least 20% of the available internal volume of the reaction zone. If a vapor-contacting zone 47 is provided at the top of the reaction zone, it should occupy no more than 15% of the internal volume of the reaction zone, and preferably occupy less than 10% of this volume when intended to function solely as a vapor-liquid contacting zone. This contacting zone is intended to minimize the carryover of unconverted feed components to the product recovery portion of the process. It has been determined that the cost of providing and operating the vapor-liquid contacting zone is normally greater than performing this recovery of unconverted materials downstream. Therefore the process can be performed successfully without a contacting zone being located in each reaction zone. If employed in the process, the contacting zone may take many forms as there is a wide variety of suitable vapor-liquid contacting equipment known to those skilled in the art. The contacting zone can take the form of fixed or structured packing or dumped packing. Preferably the contacting material of zone 47 comprises several e.g. 3–5 vapor-liquid contacting trays such as sieve trays having an active surface containing numerous evenly distributed perforations. The vapor-liquid recontacting and distribution devices often used at intermediate points within a hydrocracking reaction zone for admixture and distribution of vapor and liquid phases may also be adapted for operation in this contacting zone. Alternatively the contacting zone 47 may contain catalytic material which promotes hydrotreating of the product material being removed overhead. This can compensate for poorer quality products resulting from a lower pressure operation. In this alternative large surface area hydrotreating catalyst can be placed in the contacting zone 47. This mode of operation results in the preference for a larger relative size for the contacting zone and it may consume 20–40 percent of the volume of the reaction zone.

One embodiment of the invention may therefore be characterized as a hydrocarbon conversion process which comprises dividing a feed stream into a number of portions having the same composition and passing each portion of the feed stream into a separate on-stream reaction zone of a reaction section comprising at least two on-stream reaction zones and at least one regenerating reaction zone all of substantially equal configuration and operated at substantially the same pressure, with each reaction zone containing an upper first catalyst bed comprising hydrotreating catalyst and a lower second catalyst bed comprising hydrocracking catalyst; passing a hydrogen-rich gas stream into a lower portion of each reaction zone and upward through the reaction zone; collecting liquid phase unconverted hydrocarbons at the bottom of each on-stream reaction zone, and recycling at least a portion of the unconverted hydrocarbons to the first catalyst bed of the same reaction zone; passing vapor rising out of the first catalyst bed of each reaction zone upward through a vapor-liquid contacting zone located within the reaction zone; combining vapor rising out of the contacting zone of the on-stream reaction zones and the regenerating reaction zone and passing the resultant combined gas stream to a product recovery section of the process, and returning the regenerating reaction zone to on-stream operation and sequentially regenerating a different reaction zone to provide a continuous process.

Suitable catalysts for use in all reaction zones of this process are available commercially from a number of vendors. The fundamental difference between hydrotreating and hydrocracking catalysts is the presence of a high activity cracking component in the hydrocracking catalyst. This may be an amorphous or a zeolitic component. It is preferred that the hydrocracking catalyst comprises between 1 wt. % and 90 wt. % Y zeolite, preferably between 10 wt. % and 80 wt. % as a cracking component. In the case of a monolith catalyst, compositions are in terms of the active wash coat layer unless otherwise stated. A zeolitic catalyst will normally also comprise a porous refractory inorganic oxide support (matrix) which may form between about 10 and 99 wt. %, and preferably between 20 and 90 wt. % of the support of the finished catalyst composite. The matrix may comprise any known refractory inorganic oxide such as alumina, magnesia, silica, titania, zirconia, silica-alumina and the like and preferably comprises a combination thereof such as silica-alumina. It is preferred that the support comprises from about 5 wt. % to about 45 wt. % alumina. A preferred matrix for a particulate hydrocracking catalyst comprises a mixture of silica-alumina and alumina wherein the silica-alumina comprises between 15 and 85 wt. % of the matrix.

Y zeolite has the essential X-ray powder diffraction pattern set forth in U.S. Pat. No. 3,130,007. The as synthesized zeolite is modified by techniques known in the art which provide a desired form of the zeolite. Modification techniques such as hydrothermal treatment at increased temperatures, calcination, washing with aqueous acidic solutions, ammonia exchange, impregnation, or reaction with an acidity strength inhibiting specie, and any known combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. The Y zeolites marketed by UOP LLC of Des Plaines, Ill. under the trademarks Y-82, Y-84, LZ-10 and LZ-20 are suitable Y zeolite materials. These zeolites have been described in the patent literature. It is contemplated that other zeolites, such as Beta, Omega, L or ZSM-5, could be employed as the zeolitic component of the hydrocracking catalyst in place of or in addition to the preferred Y zeolite.

A silica-alumina component of the hydrocracking or hydrotreating catalyst may be produced by any of the numerous techniques which are well described in the prior art relating thereto. Such techniques include the acid-treating of a natural clay or sand, and co-precipitation or successive precipitation from hydrosols. These techniques are frequently coupled with one or more activating treatments including hot oil aging, steaming, drying, oxidizing, reducing, calcining, etc. The pore structure of the support or carrier, commonly defined in terms of surface area, pore diameter and pore volume, may be developed to specified limits by suitable means including aging a hydrosol and/or hydrogel under controlled acidic or basic conditions at ambient or elevated temperature.

An alumina component of the catalysts may be any of the various suitable hydrous aluminum oxides or alumina gels such as alpha-alumina monohydrate of the boehmite structure, alpha-alumina trihydrate of the gibbsite structure, beta-alumina trihydrate having a bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The finished particulate catalysts for utilization in the subject process should have a surface area of about 200 to 700 square meters per gram, a pore diameter range of about 20 to about 300 Angstroms, a pore volume of about 0.10 to about 0.80 milliliters per gram, and an apparent bulk density within the range of from about 0.50 to about 0.90 gram/cc. Surface areas above 350 $m^2/g$ are greatly preferred.

The composition and physical characteristics of the catalysts such as shape and surface area are not considered to be limiting upon the utilization of the present invention. The catalysts may exist in the form of spheres or various special shapes such as trilobal extrudates or monoliths disposed as a fixed bed within a reaction zone. The most controlling shape related factor is the pressure drop through the bed at the desired gas flow rates as described above. This is preferably accomplished by the use of hydrotreating and hydrocracking catalysts having a void fraction greater than 0.55.

The catalyst particles may be prepared by any method known in the art including the well-known oil drop and extrusion methods. Extrusion involves mixing the zeolite or other cracking component, either before or after adding metallic components, with the binder and a suitable peptizing agent to form a homogeneous dough or thick paste having the correct moisture content to allow for the formation of extrudates with acceptable integrity to withstand further handling and subsequent calcination. Extrusion is through a die pierced with multiple holes and the spaghetti-shaped extrudate is cut to form particles in accordance with techniques well known in the art. A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form by means known to the art.

A spherical catalyst may be formed by use of an oil dropping technique such as described in U.S. Pat. Nos. 2,620,314; 3,096,295; 3,496,115 and 3,943,070, which are incorporated herein by reference. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. The resulting aged and gelled particles are then washed and dried at a relatively low temperature of about 50–200° C. and subjected to a calcination procedure at a temperature of about 450–700° C. for a period of about 1 to about 20 hours. This treatment effects conversion of the hydrogel to the corresponding alumina matrix. The zeolite and silica-alumina must be admixed into the aluminum containing sol prior to the initial dropping step. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

Hydrogenation components may be added to the catalysts before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on techniques for the preparation of hydrocracking catalysts may be obtained by reference to U.S. Pat. Nos 3,929,672; 4,422,959; 4,576,711; 4,661,239; 4,686,030; and 4,695,368 which are incorporated herein by reference.

Hydrogenation components contemplated for use in the catalysts are those catalytically active components selected from the Group VIB and Group VIII metals and their compounds. References herein to Groups of the Periodic Table are to the traditionally American form as reproduced in the fourth edition of *Chemical Engineer's Handbook,* J. H. Perry editor, McGraw-Hill, 1963. Generally, the amount of hydrogenation component(s) present in the final catalyst composition is small compared to the quantity of the other above-mentioned support components. The Group VIII component generally comprises about 0.1 to about 30% by weight, preferably about 1 to about 20% by weight of the final catalytic composite calculated on an elemental basis. The Group VIB component of the hydrocracking catalyst comprises about 0.05 to about 30% by weight, preferably about 0.5 to about 20% by weight of the final catalytic composite calculated on an elemental basis. The total amount of Group VIII metal and Group VIB metal in the finished catalyst in the hydrocracking catalyst is preferably less than 21 wt. percent. As widely appreciated concentrations of the more active and also more costly noble metals will be lower than for base metals e.g. 0.5–3 wt. %. The hydrogenation components contemplated for inclusion in the catalyst include one or more metals chosen from the group consisting of molybdenum, tungsten, chromium, iron, cobalt, nickel, platinum, palladium, iridium, osmium, rhodium, and ruthenium. The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the hydrotreating catalyst. If used phosphorus is normally present in the catalyst in the range of 1 to 30 wt. % and preferably 3 to 15 wt. % calculated as $P_2O_5$.

A preferred embodiment of the invention may accordingly be characterized as a hydrocracking process which comprises dividing a feed stream into a number of portions having the same composition and passing each portion of the feed stream into the upper portion of a separate on-stream reaction zone of a reaction section comprising at least two on-stream reaction zones and at least one off-stream reaction zone which is being regenerated, all of the reaction zones being of substantially equal configuration and operated at substantially the same pressure, with each reaction zone containing an upper first catalyst bed comprising hydrotreating catalyst and a lower second catalyst bed comprising hydrocracking catalyst, passing a hydrogen-rich gas stream into a lower portion of each reaction zone, including the regenerating reaction zone, and upward through the reaction zone, collecting liquid phase unconverted hydrocarbons at the bottom of each on-stream reaction zone into a common liquid retention zone and recycling at least a portion of the unconverted hydrocarbons to the first catalyst bed of the same on-stream reaction zone; combining vapor rising out of the contacting zone of the on-stream reaction zones and the regenerating reaction zone, and passing the resultant combined gas stream to a product recovery section of the process; returning the off-stream reaction zone to on-stream operation; beginning regeneration of a different reaction zone, with all of the reaction zones being sequentially regenerated to provide a continuous process; and, recovering a product distillate stream and a liquid hydrocarbon stream which is charged to the contacting zones from the combined gas stream.

What is claimed is:

1. A hydrocarbon conversion process which comprises:

a.) dividing a feed stream into a number of portions having the same composition and passing each portion into an upper portion of a separate on-stream reaction zone of a multi-reaction zone reaction section of the process, with the reaction section comprising at least two reaction zones of substantially equal configuration and operated at substantially the same conversion conditions, and with each reaction zone containing a catalyst bed comprising hydrocracking catalyst;

b.) passing a hydrogen-rich gas stream into a lower portion of each reaction zone and upward through the reaction zone;

c.) passing liquid phase hydrocarbons collected at the bottom of each on-stream reaction zone into a single liquid retention zone, and recycling a portion of these hydrocarbons to a catalyst bed of each on-stream reaction zone; and, d.) combining vapor rising out of each onstream reaction zone and passing the resultant combined gas stream to a product recovery section of the process.

2. The process of claim 1 wherein each reaction zone contains an upper bed of hydrotreating catalyst and a lower bed of hydrocracking catalyst.

3. The process of claim 2 wherein at least some portion of the feed stream is charged to the bed of hydrocracking catalyst.

4. A hydrocarbon conversion process which comprises:

a.) dividing a feed stream into a number of portions having the same composition and passing each portion into an upper portion of a separate reaction zone of a multi-reaction zone reaction section of the process, with the reaction section comprising at least two on-stream reaction zones of substantially equal configuration and operated at substantially the same conversion conditions and also comprising at least one off-stream reaction zone of substantially equal configuration which is being regenerated, and with each reaction zone containing an upper first catalyst bed comprising hydrotreating catalyst and a lower second catalyst bed comprising hydrocracking catalyst;

b.) passing a hydrogen-rich gas stream into a lower portion of each on-stream reaction zone and upward through the reaction zone;

c.) collecting liquid phase hydrocarbons at the bottom of each reaction zone into a common liquid retention zone and recycling at least a portion of these hydrocarbons to the first catalyst bed of an on-stream reaction zone; and, d.) combining vapor rising out of each on-stream reaction zone and passing the resultant combined gas stream to a product recovery section of the process.

5. The process of claim 4 wherein vapor rising out of the first catalyst bed is passed upward through a vapor-liquid contacting zone located within the reaction zone countercurrent to descending liquid phase hydrocarbons.

6. The process of claim 5 further characterized in that liquid phase hydrocarbons withdrawn from the downstream product recovery section are charged to the vapor-liquid contacting zone.

7. A hydrocracking process which comprises:

a.) dividing a feed stream into a number of portions having the same composition and passing each portion of the feed stream into the upper portion of a separate on-stream reaction zone of a reaction section comprising at least two on-stream reaction zones and at least one off-stream reaction zone which is being regenerated, all of the reaction zones being of substantially equal configuration and operated at substantially the same pressure, with each reaction zone containing an upper first catalyst bed comprising hydrotreating catalyst, a lower second catalyst bed comprising hydrocracking catalyst and a vapor-liquid contacting zone located above the first catalyst bed;

b.) passing a hydrogen-rich gas stream into a lower portion of each reaction zone, including the regenerating reaction zone, and upward through the reaction zone;

c.) collecting liquid phase unconverted hydrocarbons at the bottom of each on-stream reaction zone into a common liquid retention zone and recycling at least a portion of the unconverted hydrocarbons to the first catalyst bed of the same on-stream reaction zone;

d.) combining vapor rising out of the contacting zone of the on-stream reaction zones and the regenerating reaction zone, and passing the resultant combined gas stream to a product recovery section of the process;

e.) returning the off-stream reaction zone to on-stream operation;

f.) beginning regeneration of a different reaction zone, with all of the reaction zones being sequentially regenerated to provide a continuous process; and, g.) recovering a product distillate stream and a liquid hydrocarbon stream, which liquid hydrocarbon stream is charged to the vapor-liquid contacting zones, from the combined gas stream.

8. The process of claim 7 wherein the process employs at least four reaction zones and only one reaction zone is being regenerated at any one time.

9. The process of claim 7 wherein all of the collected unconverted liquid phase hydrocarbons is recycled to the first catalyst bed of the respective reaction zone.

10. The process of claim 7 wherein a pool of liquid-phase hydrocarbons is retained in the bottom of the regenerating reaction zone.

11. The process of claim 7 wherein the hydrogen-rich gas stream passed into the lower portion of each reaction zone has a higher temperature than the feed stream passed into the reaction zone.

12. The process of claim 7 wherein either the hydrotreating catalyst or the hydrocracking catalyst or both are in the form of a monolith catalyst having a void fraction greater than 0.55.

* * * * *